United States Patent [19]

Morii et al.

[11] Patent Number: 4,821,659

[45] Date of Patent: Apr. 18, 1989

[54] WORKPIECE HOLDING DEVICE FOR A SEWING MACHINE

[75] Inventors: Satoshi Morii, Nagoya; Kunihiko Murata, Tsushima; Hiroyuki Mitsui, Kasugai, all of Japan

[73] Assignee: Brother Kogyo Kabushiki Kaisha, Aichi, Japan

[21] Appl. No.: 188,174

[22] Filed: Apr. 26, 1988

Related U.S. Application Data

[63] Continuation of Ser. No. 125,325, Nov. 25, 1987.

[30] Foreign Application Priority Data

Dec. 1, 1986 [JP] Japan ..... 61-185292

[51] Int. Cl.[4] ..... D05B 21/00; D05B 35/00

[52] U.S. Cl. ..... 112/121.15; 112/147; 223/38

[58] Field of Search ..... 112/121.15, 121.12, 112/121.11, 147; 223/38; 292/302; 402/DIG. 4

[56] References Cited

U.S. PATENT DOCUMENTS

| | | | |
|---|---|---|---|
| 2,673,666 | 3/1954 | Silverman | 223/38 |
| 3,552,336 | 1/1971 | Brandriff et al. | 112/121.15 |
| 3,667,411 | 6/1972 | Perlino . | |
| 3,930,454 | 1/1976 | Perlino | 223/38 X |
| 4,463,697 | 8/1984 | Vogt et al. | 112/147 X |

FOREIGN PATENT DOCUMENTS

| | | |
|---|---|---|
| 60-195686 | 12/1985 | Japan . |
| 1534816 | 12/1978 | United Kingdom . |
| 2032990 | 5/1980 | United Kingdom . |
| 2038923 | 7/1980 | United Kingdom . |

*Primary Examiner*—H. Hampton Hunter

*Attorney, Agent, or Firm*—Parkhurst, Oliff & Berridge

[57] ABSTRACT

A workpiece holding device for a sewing machine is disclosed. When a workpiece holder is connected to a supporter, a connecting rod having a peripheral groove and extending from the workpiece holder is inserted into a horizontal hole formed in the supporter. In this case, the peripheral groove of the connecting rod is positioned to communicate with a vertical hole formed in the supporter. A piston rod slidably provided in the vertical hole is actuated by an air cylinder mechanism to be engaged with the peripheral groove of the connecting rod. In order to firmly engage the connecting rod and the piston rod, spring mechanism is also provided in addition to the air cylinder mechanism. Thus, the workpiece holder can be fixedly connected to the supporter, and easily detached from the supporter without tools and troublesome operations.

4 Claims, 5 Drawing Sheets

WORKPIECE HOLDING DEVICE FOR A SEWING MACHINE

This is a continuation of application Ser. No. 125,325 filed Nov. 25, 1987.

BACKGROUND OF THE INVENTION

1. Field of the Invention

This invention relates to a workpiece holding device, especially to a cloth holders for a sewing machine.

2. Prior Art

It is known that pocket edge folding operation is executed as follows in a prior art device.

In response to various contour of a patch pocket, a plurality of workpiece holding plates such as gage plates, holding plates and folder base plates are optionally coordinated and then connected to a supporting member of a pocket folding device. After the patch pocket is set on the gage plate, the holding plate is put on the gage plate with the patch pocket between, so that the peripheral edge of the patch pocket is folded downward. Then, folders are slidably inserted along the back surface of the gage plate from the outside, thereby the peripheral edge of the patch pocket is folded back.

In such a device, since the holding plates are each fixed to the supporting member with bolts (for example, see U.S. Pat. No. 3,667,411), a tool such as a screwdriver and troublesome operation are required to exchange the holding plates. Moreover, the bolts are apt to loosen during the folding operation, resulting in deteriorating the accuracy of holding operation.

A holding device for holding a cloth is disclosed in the Japanese published unexamined utility model application No. 60-195686 in which a cloth holding plate is attached to a supporting member with an easy connecting mechanism. But in this holding device, the supporting member does not move upward nor downward in relation to the table of the machine. Further, the connecting mechanism is different from that of the present invention hereinunder described.

SUMMARY OF THE INVENTION

Accordingly, it is an object of the present invention to provide a workpiece holding device for a sewing machine in which the holding plates and gage plates can be easily exchanged and fixedly connected to the supporting member of the holding device.

To achieve this and other objects, the present invention has a constitution set forth. Namely, a workpiece holding device for a sewing machine which is equipped with a table, a supporting member movably supported on the table in upward and downward movements, actuating means for actuating the supporting member, a workpiece holding plate and connecting mechanism for detachably connecting the workpiece holding plate with the supporting member, is characterized in that the connecting mechanism includes:

at least one connecting rod provided on either one of the supporting member or the holding plate;

at least one hole formed in the other side of the supporting member or the holding plate for slidably receiving the connecting rod along an axis thereof;

a latch means for latching said connecting rod at an inserted position.

The latch means are embodied by a stepped portion formed on the connecting rod and the engaging member. The stepped portion may be a protrusion or a groove.

BRIEF DESCRIPTION OF DRAWINGS

By way of example and to make the description more clear, reference is made to the accompanying drawings in which.

DETAILED DESCRIPTION OF THE PREFERRED EMBODIMENT

A preferred embodiment of the present invention is set forth with reference to the attached drawings.

Figure 3:
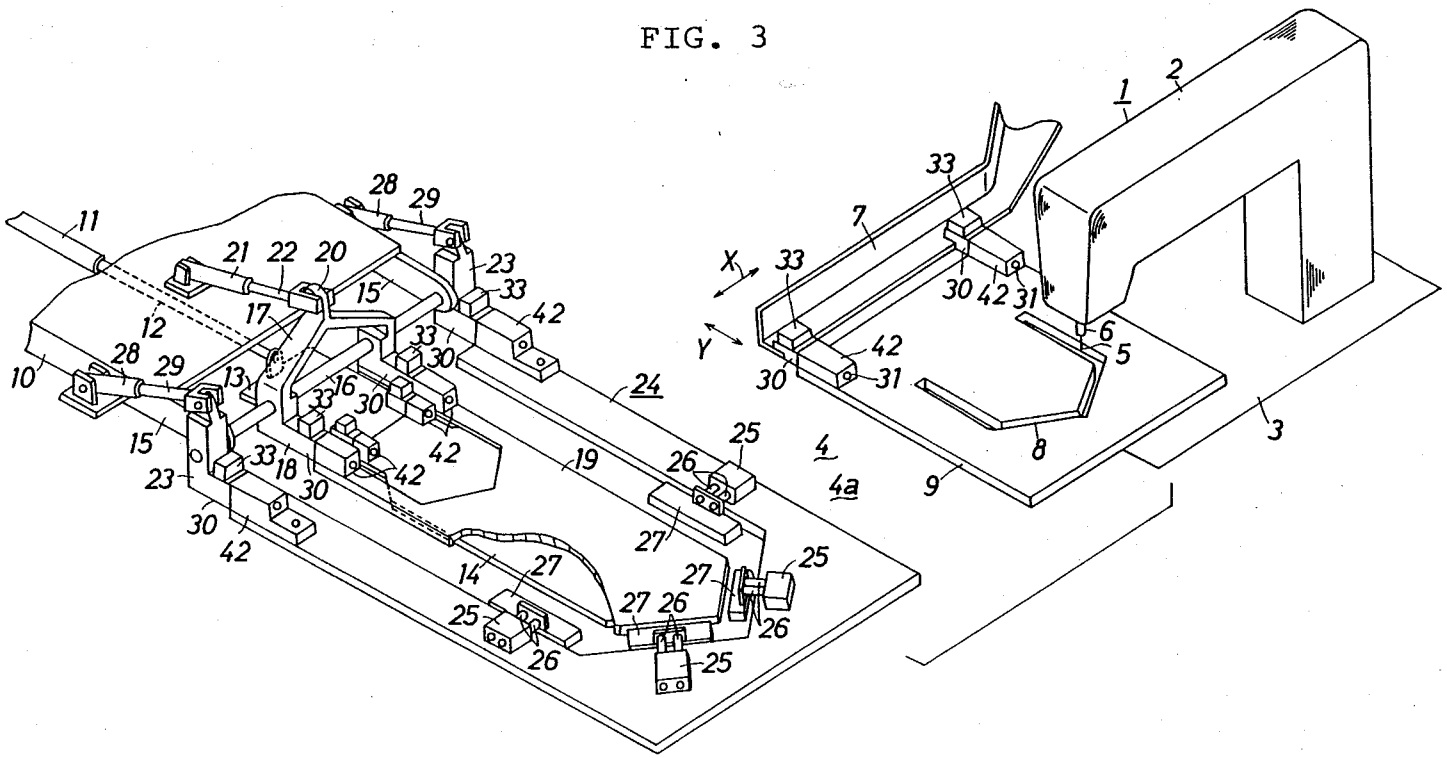
FIG. 3 is a perspective view of a pocket folding device and a sewing machine of the present invention.

As shown in FIG. 3, a sewing machine 1 includes a machine arm 2 and a machine bed 3. The machine bed 3 is positioned to flush with the upper surface of a machine table 4. A needle bar 6 with a needle 5 at its lower end is attached to the machine arm 1 to be vertically movable. A loop taker (not shown) which cooperates with the needle 5 to form a stitch is installed within the machine bed 3. A guide arm 7 is provided on the machine table 4 to be movable in both X and Y axes shown in FIG. 3. A guide plate 9 including a needle guide groove 8 is removably attached to the front part of the guide arm 7.

As to be explained referring to FIGS. 4A through 4H, a cloth W and a patch pocket P to be stitched on the cloth W are held on the machine table 4 by the guide plate 9. Under such condition, a known stitch forming mechanism is started and the guide plate 9 is moved in X and Y directions so that the needle moves along the needle guide groove 8. Thus, the patch pocket P is stitched on the cloth W.

The operation for folding the peripheral edge of the patch pocket P is set forth. As shown in FIG. 3, a supporting member 10 is provided above the machine table 4 to be rotatable around a horizontal axis. An air cylinder 11 including a piston 12 is provided under the supporting member 10. A gage plate supporter 13 which is attached to the front end of the piston 12 is positioned in the front of the supporting member 10. A gage plate 14, on which the patch pocket P is set for determining the contour of the pocket, is removably attached to the gage plate supporter 13.

Two arms 15 are projecting in parallel from both edges of the front end of the supporting member 10. The axis 16 is bridged across the arms 15 at a right angle to them. A holding plate supporter 17 is attached to the axis 16 to be rotatable around the axis 16. Moreover, a holding plate 19 is removably attached by a pair of attaching member 18 which are extending from the supporting member 17. A connecting head 20 projecting from the center of the upper side of the supporting member 17 is connected to a piston 22 of an air cylinder 21-which is rotatably attached to the upper surface of the supporting member 10. The piston 22 functions to pivotally move the holding plate 19 between a preparatory position above the gage plate 14 and an operational position on the gage plate 14.

Both ends of the axis 16 are supported by a pair of arms 15. A pair of supporting blocks 23 are pivotally supported by the both ends of the axis 16. A U-shaped folder base plate 24 is removably attached to the front ends of the supporting blocks 23. The front end of the holding plate 19 is surrounded by four air cylinders 25 which include pistons 26. Each of the piston 26 is equipped with a folder 27 which is moved between the operational position under the gage plate 14 and the preparatory position apart from the gage plate 14 by actuating the piston 26.

On the other hand, the upper end of the supporting blocks 23 and the supporting member 10 are connected by a pair of air cylinders 28 including pistons 29. The base of the cylinders 28 are pivotally attached to the both sides of the supporting member 10. The pistons 29 are each connected to the upper end of the blocks 23.

Figure 4A:
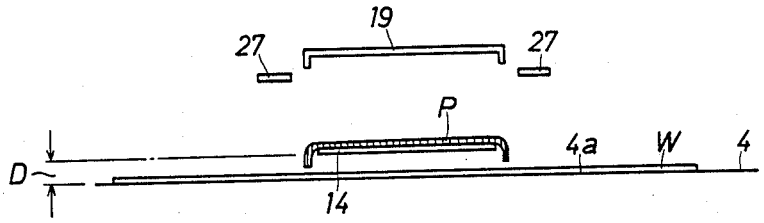
FIGS. 4A, 4B, 4C, 4D, 4E, 4F, 4G and 4H illustrate steps of the process for folding the peripheral edge of a patch pocket by the folding device of the present invention.
Figure 4B:
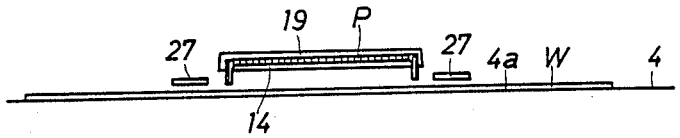
Figure 4C:
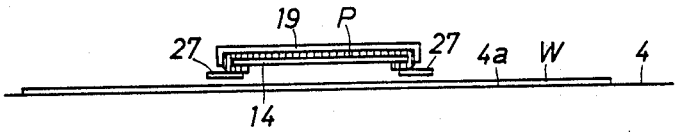

Set forth is the description of the processes for stitching the patch pocket P onto the cloth W by utilizing the pocket folding device of the present invention and a sewing machine. First, the peripheral edge of the patch pocket P is folded. Namely, the gage plate 14, the holding plate 19 and the folder base plate 24 are raised with the supporting plate 10 so that the gage plate 14 is set at the preparatory position at a distance D apart from a surface 4*a* of the machine table 4 as shown in FIG. 4A. Then, the air cylinders 21 and 28 are actuated to raise the folder base plate 24 and the holding plate 19. Under this condition, the cloth W is put on the table surface 4*a* under the gage plate 14, and the patch pocket P is put on the gage plate 14. Next, the air cylinders are actuated to lower the holding plate 19 and the folder base plate 24 so that the holding plate 19 is put on the gage plate 14. Thus, the peripheral edge of the patch pocket P is folded downward along the contour of the gage plate 14 as shown in FIG. 4B. After that, the folders 27 are inserted under the gage plate 14 as illustrated in FIG. 4C by actuating the air cylinders 25 so that the peripheral edge of the patch pocket P is folded back.

Figure 4D:
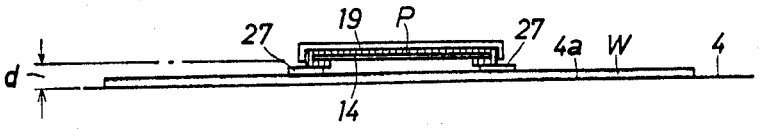
Figure 4E:
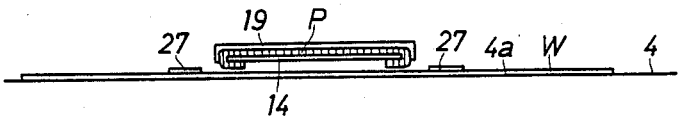
Figure 4F:
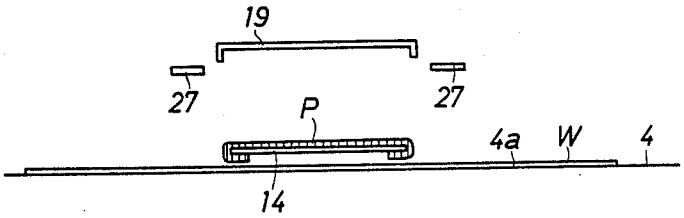

Next, as shown in FIG. 4D, the gage plate 14, the holding plate 19 and the folder base plate 24 are lowered with the supporting member 10 so that the distance d between the table surface 4*a* of the machine table 4 and the gage plate 14 becomes smaller than the distance D shown in FIG. 4A. Subsequently, the air cylinders 25 are actuated to return the folders 27 to the preparatory position as shown in FIG. 4E. Then, the folder base plate 24 and the holding plate 19 are raised by actuating the air cylinders 21 and 28 to keep them away from the patch pocket P as shown in FIG. 4F.

Figure 4G:
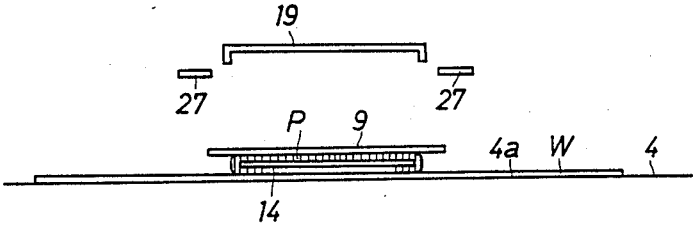
Figure 4H:
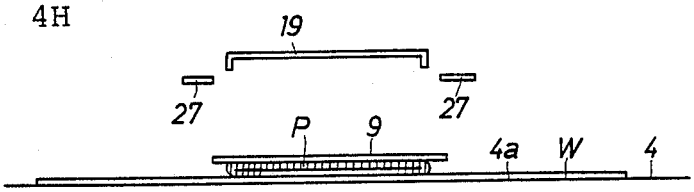

Under the above-mentioned condition, the guide plate 9 is placed on the patch pocket P, and is actuated to depress the patch pocket P with the gage plate 14 onto the cloth W as illustrated in FIG. 4G. Next, by actuating the piston 12 of the air cylinder 11, the guide plate 14 is drawn back to be detached from the patch pocket P as shown in FIG. 4H. Under the condition that the patch pocket P and the cloth W are fixed on the table surface 4*a* by the guide plate 9, the guide plate 9 is set at the stitching point. Thus, the patch pocket P is stitched on the cloth W by the sewing machine.

Set forth is the explanation for the cooperation of the supporting member including the gage plate supporter 13, holding plate supporter 17 and the supporting block 23, and the holding member including the gage plate 14, holding plate 19 and the folder base plate 24. For an example, the cooperation of the the supporting block 23 and the folder base plate 24 is explained based on FIG. 1.

Figure 2:
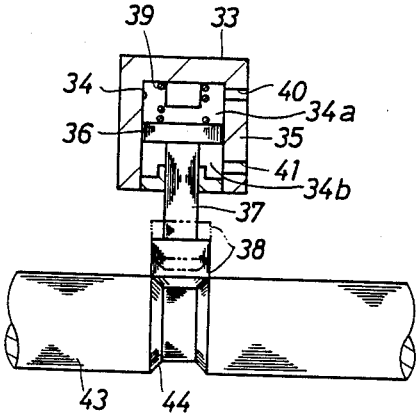
FIG. 2 is a sectional view of a connecting rod and an air cylinder of the present invention.

The supporting block 23 and the connector 30 of the guide arm 7 include a horizontal hole 31 which is longitudinally extending in perpendicular to the axis 16, and a vertical hole 32 communicating with the horizontal hole 31. A connecting air cylinder 33 is provided on the connector 30. As shown in FIG. 2, the connecting air cylinder 33 is composed of a frame 35 including a chamber 34 and a piston rod 37 with a base flange 36 which is movably inserted into the chamber 34. The chamber 34 is separated into an upper chamber 34*a* and a lower chamber 34*b* by the base flange 36. A plug 38 is provided at the tip of the piston rod 37. By actuating the piston rod 37, the plug 38 is moved up and down through the vertical hole 32 to appear and disappear in the horizontal hole 31. A spring 39 for pushing the piston rod 37 is provided between the base flange 36 and the inner surface of the chamber 34. In the side wall of the frame 35, two air inlets 40 and 41 which are respectively communicating with the upper chamber 34*a* and the lower chamber 34*b* are formed.

Figure 1:
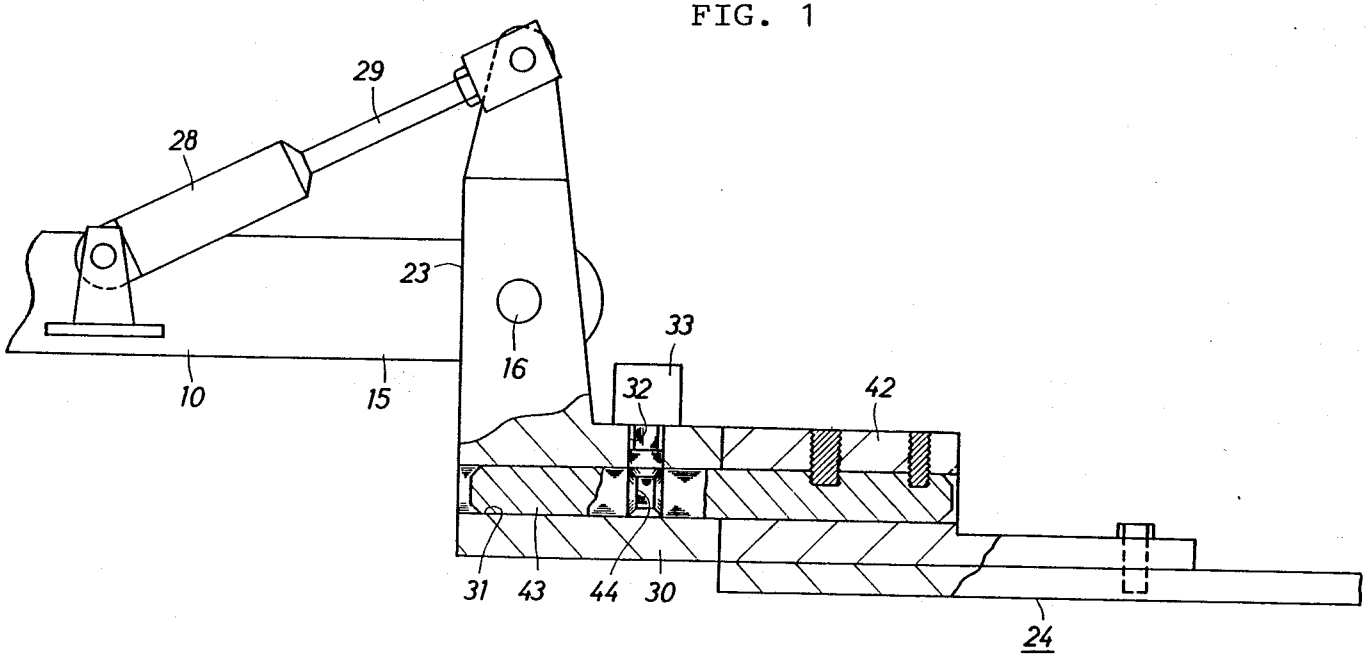
FIG. 1 is a sectional view illustrating a connecting mechanism of a workpiece holding device for detachably connecting a workpiece holding plate with a supporting member.

As illustrated in FIG. 1, a connecting rod 43 is attached to a connecting block 42 which is formed at the base of the holding member including the folder base plate 24 and the guide plate 9. The connecting rod 43 being longitudinally extending at a right angle to the axis 16 is removably inserted into the horizontal hole 31 of the connector 30. The connecting rod 43 has a groove 44 around its peripheral surface. When the connecting rod 43 is inserted into the horizontal hole 31 of the connector 30, the peripheral groove 44 is positioned to communicate with the vertical hole 32. Then, the plug of the piston rod 37 can be engaged with the peripheral groove 44.

The operation for installing the gage plate 14, the holding plate 19, the folder base plate 24 and the guide plate a corresponding to a predetermined contour of the patch pocket P is hereinunder described.

First, air is supplied via the air inlet 41 to the lower chamber 34*b* of the air cylinder 33, so that the piston rod 37 is pushed up to the preparatory position shown by a two-dot chain line in FIG. 2. Under such condition, the connecting rod 43 of the gage plate 14, the holding plate 19, the folder base plate 24 and the guide plate 19 are each inserted into the horizontal hole 31 of the gage plate supporter 13, the holding plate supporter 17, the supporting block 23, and the guide arm 7, respectively. Then, the peripheral groove 44 of the connecting rod 43 is positioned to communicate with the vertical hole 32 of the air cylinder 33. Subsequently, the air supply via the air inlet 41 is stopped and the remaining air in the lower chamber 34*b* is exhausted. At the same time, air is supplied via another air inlet 40 into the upper chamber 34*a*. As a result, the piston rod 37 is pushed down so that the plug 38 is engaged with the peripheral groove 44. Since the plug 38 and the groove 44 are firmly engaged, the connecting rod 43 hardly disconnects from the connector 30.

In the present embodiment, the spring 39 is provided between the base flange 36 and the inner surface of the chamber 34 so that the plug 38 is firmly engaged with the peripheral groove 44 by the spring force. Namely, even if the air supply to the chamber 34 is terminated or the pressure within the chamber 34 is changed, the plug 38 is not easily released from the peripheral groove 44.

After the plug 38 is engaged with the groove 44, the cloth W and the patch pocket P are set. By operating the sewing machine and the folding device, the patch pocket P is automatically stitched on the cloth W.

On the other hand, when a patch pocket having a different contour is stitched on the cloth W, each element of the folding device, i.e., the gage plate 14, the holding plate 19, the folder base plate 24 and the guide plate 9 must be exchanged. In this case, the air supply via the air inlet 40 is stopped and the remaining air in the upper chamber 34*a* is exhausted. At the same time, air is supplied to the lower chamber 34*b* via the air inlet 41. Thus, the piston 37 is returned to the preparatory position shown by a two-dot chain line in FIG. 2, and the plug 38 is disconnected from the peripheral groove 44. Thus, the gage plate 14, the holding plate 19, the folder base plate 24 and the guide plate 9 are easily detached by removing the connecting rod 43 from the horizontal hole 31.

In this embodiment, since the connecting rod 43 is firmly inserted into the horizontal hole 31, the gage plate 14, the holding plate 19 and the folder base plate 24 never become unstable while they are raised or lowered between the preparatory position apart from the table surface 4*a* and the operational position on the table surface 4*a*.

While the invention has been practically shown and described with reference to preferred embodiments, it will be understood by those skilled in the art that various other modifications may be made without departing from the spirit and scope of the invention. For example, the connecting rod 43 can be provided to the supporting member, and also it is possible to provide the horizontal hole 31 and the connecting air cylinder 33 to the holding plate. Moreover, the present invention can be embodied by a workpiece holder for a sewing machine utilized for embroidering figure patterns or stitching an applique or the like onto a cloth.

Further, the combination of the plug 38 and the groove 44 of the connecting rod 43 as shown in FIG. 3 is replaced by any other combination that can hold the rod 43 firmly. For example, a protrusion is placed on the peripheral surface of the connecting rod 43 and the plug 38 is forked to hold the protrusion. Another example is a key hole provided on the connecting rod 43 and a key in place of the plug 38. Further example is a slit cut formed in the connecting rod 43 and an engaging plate to be fitted into the slit. Such engaging mechanism and other mechanism are included in the stepped portion on the connecting rod 43 and the engaging member as claimed in the following claims.

What is claimed is:

1. A workpiece holding device for a sewing machine comprising a table, a supporting member movably supported on the table in upward and downward movements, actuating means for actuating the supporting member, a workpiece holding plate and connecting mechanism for detachably connecting the workpiece holding plate with the supporting member, characterized in that said connecting mechanism comprises;

at least one connecting rod provided on either one of said supporting member or said holding plate;

at least one hole formed in the other of said supporting member or said holding plate for slidably receiving the connecting rod along an axis thereof;

a latch means for latching said connecting rod at an inserted position, said latch means including an engaging portion formed on said connecting rod, an engaging member for engaging with the engaging portion, and an actuating means for actuating said engaging member to engage with said engaging portion.

2. A workpiece holding device for a sewing machine comprising a table, a supporting member movably supported on the table in upward and downward movements, actuating means. for actuating the supporting member, a workpiece holding plate and connecting mechanism for detachably connecting the workpiece holding plate with the supporting member, characterized in that said connecting mechanism comprises;

a plurality of connecting rods provided on said workpiece holding plate and horizontally extending therefrom;

a groove formed on each peripheral surface of the connecting rods;

a plurality of horizontal holes formed in said supporting member each for slidably receiving each of the connecting rods along an axis thereof;

a plurality of engaging members movably supported on the supporting member each for engaging with the groove of the connecting rod inserted into the horizontal hole; and a plurality of actuating means for actuating the engaging members.

3. A workpiece holding device for a sewing machine according to claim 2, wherein said groove includes a peripheral notch; and said engaging member is slidably supported in a vertical hole which formed in said supporting member so as to intersect to said horizontal hole.

4. A workpiece holding device for a sewing machine according to claim 3, wherein said actuating means includes an air cylinder; and said engaging member is a piston rod of the air cylinder.

* * * * *